US009908745B2

(12) United States Patent
De Kroon et al.

(10) Patent No.: US 9,908,745 B2
(45) Date of Patent: Mar. 6, 2018

(54) STAIRLIFT

(71) Applicant: Handicare Stairlifts B.V., Heerhugowaard (NL)

(72) Inventors: Marthijs De Kroon, Noord-scharwoude (NL); Dov Rosenthal, Amstelveen (NL)

(73) Assignee: Handicare Stairlifts B.V., Heerhugowaard (NL)

( * ) Notice: Subject to any disclaimer, the term of this patent is extended or adjusted under 35 U.S.C. 154(b) by 0 days.

(21) Appl. No.: 15/320,508

(22) PCT Filed: Jun. 26, 2015

(86) PCT No.: PCT/NL2015/050469
§ 371 (c)(1),
(2) Date: Dec. 20, 2016

(87) PCT Pub. No.: WO2015/199542
PCT Pub. Date: Dec. 30, 2015

(65) Prior Publication Data

US 2017/0158464 A1 Jun. 8, 2017

(30) Foreign Application Priority Data

Jun. 27, 2014 (NL) ..... 2013085

(51) Int. Cl.
*B66B 9/08* (2006.01)

(52) U.S. Cl.
CPC ..... *B66B 9/0838* (2013.01); *B66B 9/08* (2013.01); *B66B 9/0815* (2013.01); *B66B 2009/0884* (2013.01)

(58) Field of Classification Search
CPC combination set(s) only.
See application file for complete search history.

(56) References Cited

U.S. PATENT DOCUMENTS 4,260,869 A * 4/1981 Slavens ..... B23K 37/0217 104/119
5,908,087 A * 6/1999 Johansson ..... B66B 9/0838 187/201

(Continued)

FOREIGN PATENT DOCUMENTS

EP 1125882 A1 * 8/2001
EP 2452909 A1 * 5/2012 ..... B66B 9/0807

(Continued)

*Primary Examiner* — Michael A Riegelman
(74) *Attorney, Agent, or Firm* — Hoffmann & Baron, LLP

(57) ABSTRACT

A stairlift for conveying a load along a staircase rail includes a rail, a carriage carried by the rail and moveable along the rail, a carriage drive to drive the carriage along the rail, a load carrier support supporting a load carrier, such as a chair or wheelchair platform, which load carrier support is rotatably connected to the carriage to rotate about a horizontal axis, a rotation device to rotate the load carrier support relative to the carriage about the horizontal axis, and a control unit to control the rotation device such that the load carrier support is positioned in a desired orientation relative to a horizontal plane. The rotation device includes a motor and a rotator, where the motor is operatively connected to the load carrier support via the rotator to cause rotation of the load carrier support relative to the carriage about the horizontal axis.

18 Claims, 8 Drawing Sheets

(56) References Cited

U.S. PATENT DOCUMENTS

| | | | | |
|---|---|---|---|---|
| 6,155,382 | A * | 12/2000 | Duijnstee | B66B 9/0815 105/30 |
| 8,607,936 | B2 * | 12/2013 | Szentistvany | B66B 9/0838 104/230 |
| 2012/0073908 | A1 * | 3/2012 | Rosenthal | B66B 9/08 187/201 |
| 2014/0083801 | A1 * | 3/2014 | Vroegindeweij | B66B 9/0815 187/201 |
| 2017/0233223 | A1 * | 8/2017 | Hoedjes | B66B 9/0838 187/201 |
| 2017/0247227 | A1 * | 8/2017 | Rosenthal | B66B 9/0815 |

FOREIGN PATENT DOCUMENTS

| | | | |
|---|---|---|---|
| WO | 2012/093941 | A1 | 7/2012 |
| WO | 2012/120286 | A2 | 9/2012 |

* cited by examiner

STAIRLIFT

CROSS-REFERENCE TO RELATED APPLICATIONS

This application is the National Stage of International Application No. PCT/NL2015/050469 filed Jun. 26, 2015, which claims the benefit of Netherlands Application No. NL 2013085, filed Jun. 27, 2014, the contents of which is incorporated by reference herein.

FIELD OF THE INVENTION

The invention relates to a stairlift for conveying a load along the staircase. The stairlift comprises a rail, and a carriage carried by the rail and movable along the rail. The carriage comprises a carriage drive to drive the carriage along the rail.

BACKGROUND OF THE INVENTION

These stairlifts are often used to convey a person who has difficulties with walking along the staircase. The rail extends in said situation along the staircase. In practise, the rail often does not extend along a straight line, but has one or more bends. These bends can be in any direction, which means the bends can be in the vertical direction and/or in the horizontal direction. The rail can therefore have a varying angle relative to a horizontal plane and/or a varying angle relative to a vertical plane.

To keep the load carrier, such as a chair or wheelchair platform, in a desired orientation relative to a horizontal plane, the stairlift is provided with a rotation device configured to rotate the load carrier about a horizontal axis. In most cases, the load carrier is kept in a horizontal orientation while the carriage is moved along the parts of the rail with a varying angle.

In the known stairlifts dangerous situations may arise when the rotation device (for whatever reason) stops functioning. This can lead to the situation that the load carrier falls down with a pivot movement about the horizontal axis.

WO2012/12086 discloses in FIG. 2 a levelling system having a levelling motor which drives a first worm gear. The first worm gear engages a worm wheel in order to rotate it. A locking mechanism is provided as a safety back-up arrangement. The locking mechanism comprises a second worm gear which is rotated synchronically with the worm wheel. The second worm gear does not engage the worm wheel. There is a clearance between the second worm gear and the worm wheel, due to which the second worm cannot drive the worm wheel. If there is a failure at the levelling motor or the first worm gear, the second worm gear acts as a locking mechanism to lock the worm wheel. This means that the first worm gear only has the function of driving the worm wheel and the second worm gear only has the function of locking the worm wheel.

SUMMARY OF THE INVENTION

It is an objective of the invention to provide a stairlift which at least partly eliminates the abovementioned drawbacks or in any case to provide an alternative.

This objective is achieved by the stairlift according to the present invention.

Because the rotation device is provided with a second rotator which actively contributes to the rotation of the load carrier support about the horizontal axis, a safety measure is provided for when one of the two rotators stops functioning. When a rotator stops functioning, the rotator is not able to perform its normal tasks. This can be caused by the fact that the rotator is broken, but it can also have other causes. If the first rotator fails, the load carrier support can still be rotated relative to the carriage about the horizontal axis by the second rotator.

In an embodiment of the stairlift according to the invention, the at least one motor of the rotation device comprises a first motor and a second motor, the first motor is operatively connected to the load carrier support via the first rotator, and the second motor is operatively connected to the load carrier support via the second rotator. By using not just a first motor and a first rotator, but also a second motor and a second rotator, also a safety measure is provided for when on of the two motors stops functioning. In addition, the two motors can be smaller when compared with the situation that only one motor is used. This makes it possible to design a smaller carriage, which is suitable for use in relative small staircases.

In an embodiment of the stairlift according to the invention, the control unit is configured to operate the second motor in unison with the first motor.

In an embodiment of the stairlift according to the invention, the first motor and the second motor have substantially the same level of power output. Both motors may contribute in the same degree to the created rotation of the load carrier support. It is economical, both from a design point of view and a maintenance point of view, to use the same type of motor for both the first and second motor.

In an embodiment of the stairlift according to the invention, the first rotator comprises a first pinion and a first toothed surface, wherein the first toothed surface is drivingly connected to the load carrier support, and the first pinion is drivingly connected to the first motor and engages the first toothed surface. This is a compact and reliable form of transmission.

In an embodiment of the stairlift according to the invention, the second rotator comprises a second pinion and a second toothed surface, wherein the second toothed surface is drivingly connected to the load carrier support, and the second pinion is drivingly connected to the second motor and engages the second toothed surface. By using a pinion and toothed surface for both the first and second rotator, the load carrier support can still be rotated, albeit at a lower rotational speed, if one of the first and second motor and/or rotator fails.

In an embodiment of the stairlift according to the invention, the rotation device comprises a central gearwheel which is drivingly, preferably rotationally fixed, connected to the load carrier support, and teeth of the central gearwheel form the first toothed surface and second toothed surface. Such a central gearwheel provides a simple and compact first and second toothed surface.

In an embodiment of the stairlift according to the invention, the first rotator comprises a first threaded spindle, and a first nut, wherein the first threaded spindle engages the first nut, and is drivingly connected to the first motor for rotating the first threaded spindle about its first longitudinal axis, and in which the first nut is connected to the load carrier support such that rotating the first threaded spindle causes a linear displacement of the first nut along the first threaded spindle. Using a first threaded spindle results in the first rotator being self-braking in case the first motor might fail. This avoids the load carrier support achieving undesired and uncontrolled angles relative to the horizontal plane, which could be dangerous for a user.

In an embodiment of the stairlift according to the invention, the first nut is connected rotatably with the load carrier support for rotating only about a first axis which is perpendicular to the first longitudinal axis of the first threaded spindle. Such a rotational connection allows the linear movement of the first nut to be transformed into a rotational movement of the load carrier support.

In an embodiment of the stairlift according to the invention, the second rotator comprises a second threaded spindle, and a second nut, wherein the second threaded spindle engages the second nut, and is drivingly connected to the second motor for rotating the second threaded spindle about its second longitudinal axis, and in which the second nut is connected to the load carrier support such that rotating the second threaded spindle causes a linear displacement of the second nut along the second threaded spindle. Using a second threaded spindle results in the second rotator being self-braking in case the second motor might fail.

In an embodiment of the stairlift according to the invention, the second nut is connected rotatably with the load carrier support for rotating only about a second axis which is perpendicular to the second longitudinal axis of the second threaded spindle.

In an embodiment of the stairlift according to the invention, the first rotator and the second rotator comprise a transmission configured to change the direction and/or speed of rotation of the first motor and the second motor, respectively.

In an embodiment of the stairlift according to the invention, the first rotator and the second rotator comprise gears configured to change the direction and/or speed of rotation of the first motor and the second motor, respectively.

In an embodiment of the stairlift according to the invention, the first motor and the second motor are electric motors.

In an embodiment of the stairlift according to the invention, the carriage drive comprises at least two drive units, which drive units are each rotatably connected to the carriage and each comprise at least one drive gearwheel engaging a gear rack of the rail.

In an embodiment of the stairlift according to the invention, each of the first motor and the second motor is configured to block the rotation of the load carrier support about the horizontal axis when the second motor or the first motor, respectively, stops functioning.

In an embodiment of the stairlift according to the invention, each of the first motor and the second motor is configured to rotate the load carrier support about the horizontal axis when the second motor or the first motor, respectively, stops functioning.

In an embodiment of the stairlift according to the invention, the second rotator is configured to operate in unison with the first rotator, and the at least one motor of the rotation device comprises only one motor which is connected to the load carrier support via the first rotator and the second rotator.

BRIEF DESCRIPTION OF THE DRAWINGS

Embodiments of the stairlift will be described by way of example only, with reference to the accompanying schematic drawings in which corresponding reference symbols indicate corresponding parts, and in which.

DETAILED DESCRIPTION OF THE INVENTION

Figure 1B:
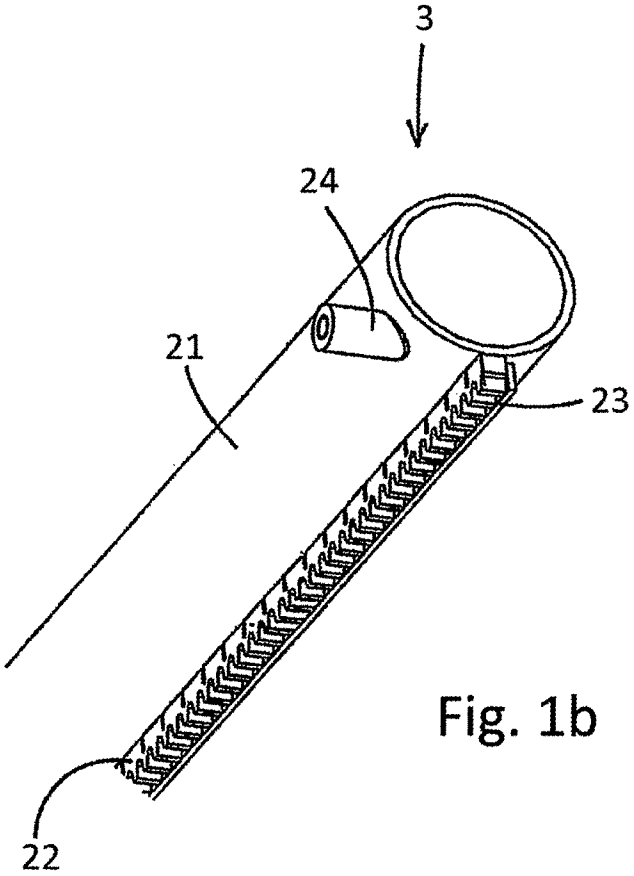
FIG. 1*b* shows the rail for the stairlift according to FIG. 1*a;*

FIG. 1 shows a stairlift 2 according to the invention. The stairlift 2 has a rail 3. An enlarged view of part of the rail 3 is shown in FIG. 1*b*. The rail 3 extends in use for example along a staircase and can therefore have various angles of inclination. The rail 3 can be mounted either at the outside or the inside bend of a staircase. A rail 3 mounted at an inside bend is usually relative steep, more steep than at an outside bend.

The stairlift 2 comprises a load carrier such as a chair 4, and a carriage 5 (often also referred to as a conveying unit or motor unit). The carriage 5 is movably connected to the rail 3 and is able to move along the rail 3.

The chair 4 comprises a backrest 6 to which folding armrests 7 are fitted. The chair 4 furthermore comprises a seat 8, on the underside of which a chair plate 9 extends downwards. At the bottom of the chair plate 9, a folding footrest 10 is provided. The chair 4 furthermore comprises a safety belt 11 and control elements 12 which are provided on one of the armrests 7.

FIG. 1*b* shows a part of the rail 3 in detail. The rail 3 comprises a tube 21, in this case a cylindrical tube, a gear rack 22, a supporting strip 23 and attachment members 24. The attachment members 24 are in use connected to supports 17 which are connected to a fixed object, for example the floor or steps of a staircase.

Figure 2B:
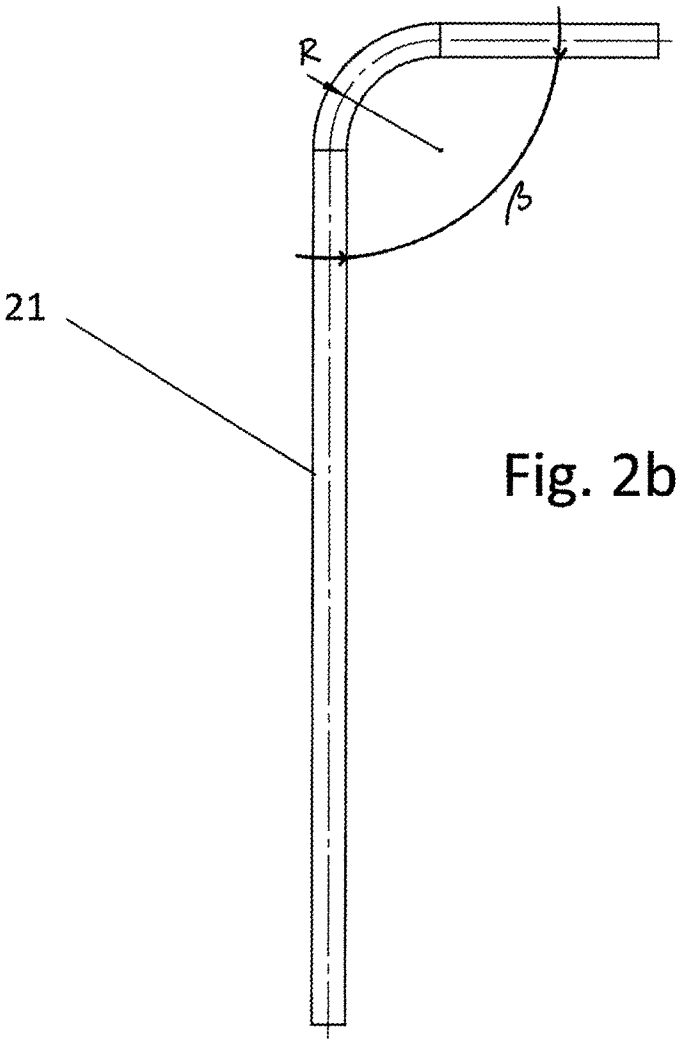
FIG. 2*b* shows the rail for the stairlift according to FIG. 1*a;*
Figure 2A:
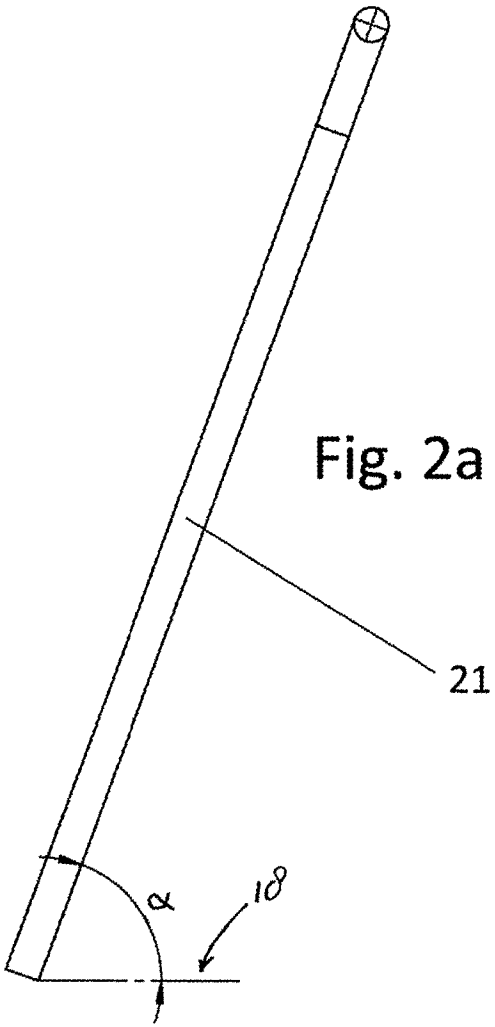
FIG. 2*a* shows the rail for the stairlift according to FIG. 1*a;*

FIG. 2*a* and FIG. 2*b* show side views of the tube 21. For convenience, the gear rack 22 is not shown. In FIG. 2*a* it is shown that the tube 21 has an angle of inclination with respect to a horizontal ground. Inclination therefore is defined as the angle ($\alpha$) of the rail 3 with respect to a horizontal plane.

In FIG. 2*b* it is shown that the tube 21 may comprise a bend defined by an angle of bend and radius of bend. Here the angle ($\beta$) of bend is 90 degrees and the radius of bend is equal to R. R is an imaginary line between a centre of a (partial) circle and an tangent line on the circle. A small R leads to a sharper bend.

Figure 3:
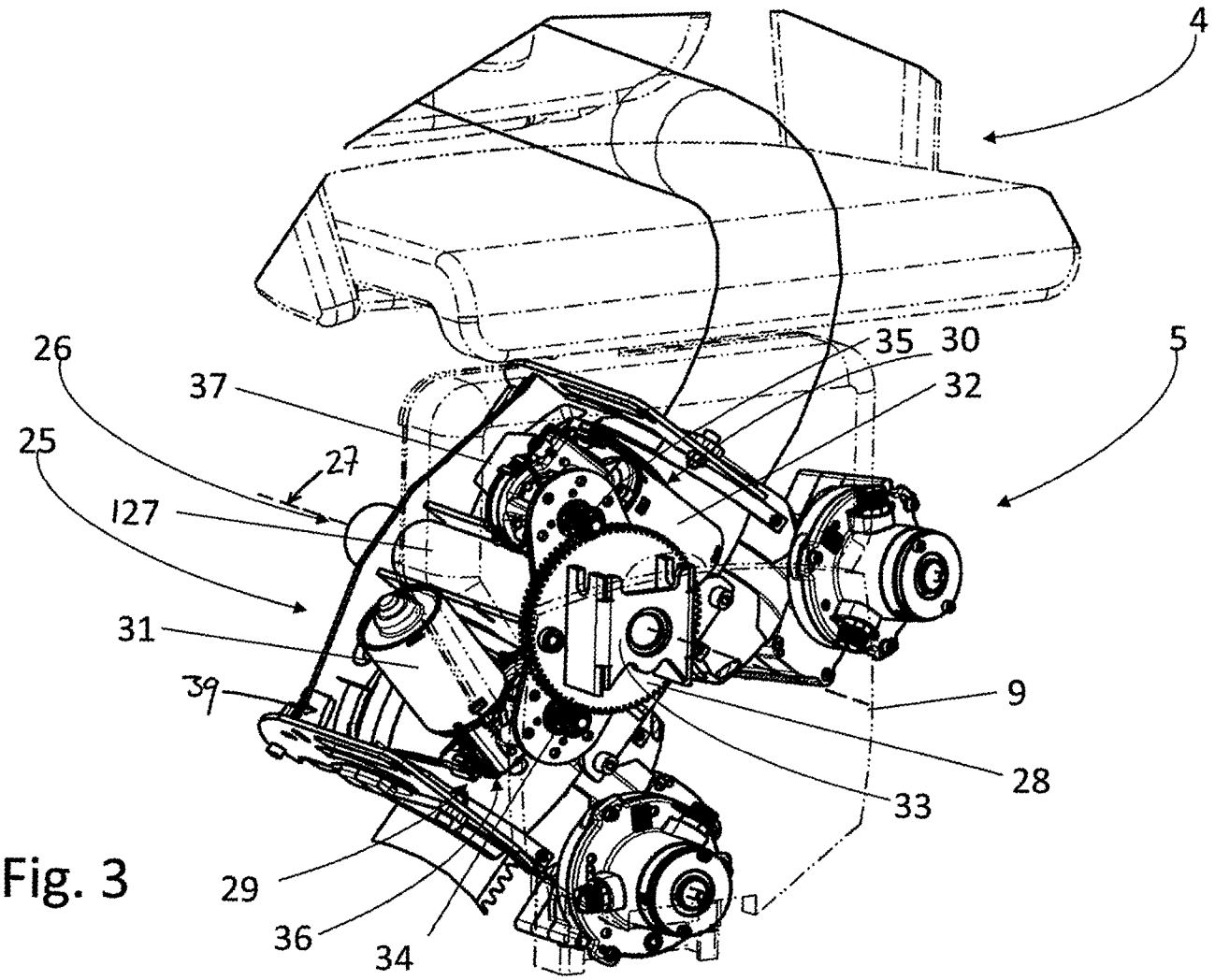
FIG. 3 shows a perspective view of the inside of the carriage of the stairlift of FIG. 1, with a part of the rail.

In FIG. 3, the chair 4 and the chair plate 9 are shown in dotted lines. The inside of the carriage 5 is shown. The carriage 5 comprises a carriage frame 25. A rotation device 26 is provided in the carriage 5, and connects the chair plate 9, and thus the chair 4, to the carriage 5. The rotation device 26 comprises a horizontal tilt axle 127, a central gearwheel 28, a first rotator 29, a second rotator 30, a first motor 31, and second motor 32. The first and second motors 31, 32 are electric motors. The central gearwheel 28 is fixedly connected to a load carrier support, in this embodiment a chair support 33. The chair support 33 allows a detachable connection with the chair plate 9 by vertically displacing the chair plate 9 with respect to the chair support 33. The chair support 33 connects the chair plate 9 and the central gearwheel 28 in a rotationally fixed manner.

The first motor 31 and the second motor 32 are connected to the chair support 33 via the first rotator 29 and the second rotator 30, respectively, in such a manner that the chair support 33 can be driven in order to rotate the chair support 33 with the chair 4 relative to the carriage 5 around a horizontal axis 27 defined by the horizontal tilt axle 127. In this embodiment, the first rotator 29 is amongst others formed by a first pinion 34 and part of the teeth of the central gearwheel 28. The second rotator 30 is amongst others formed by a second pinion 35 and part of the teeth of central gearwheel 28.

In this embodiment, the first rotator 29 further comprises a first gear transmission 36, while the second rotator 30 further comprises a second gear transmission 37. The first motor 31 is connected to the first pinion 34 via the first gear transmission 36. The second motor 32 is connected to the second pinion 35 via the second gear transmission 37. This allows placing the first and second motors 31, 32 in a favourable location and orientation in the carriage 5, while it further allows a reduction of the power for each of the first and second motor 31, 32.

The carriage 5 furthermore comprises two batteries which are connected (via a control unit 39) to the first and second motor 31, 32. The batteries are also connected to the carriage drive 41, 61 which is described below, of the carriage 5. The stairlift 2 is provided with the control unit 39, in this case an electronic control unit. The control unit 39 is configured to control the rotation device 26 such that the load carrier support 33 is positioned in a desired orientation relative to a horizontal plane. The desired orientation in general refers to the situation that the seat 8 of the chair 4 is kept in a (substantially) horizontal position while the carriage 5 is moved along the rail 3. The rail 3 can have a varying angle of inclination, which means that in use the rotation device 26 has to rotate the load carrier support 33 about the horizontal axis 27 in order to keep the seat 8 of the chair 4 in the horizontal position. The control unit 39 is electrically connected to the first and second motor 31, 32, the carriage drive 41, 61, the batteries, as well to sensors and the control elements 12.

Figure 4:
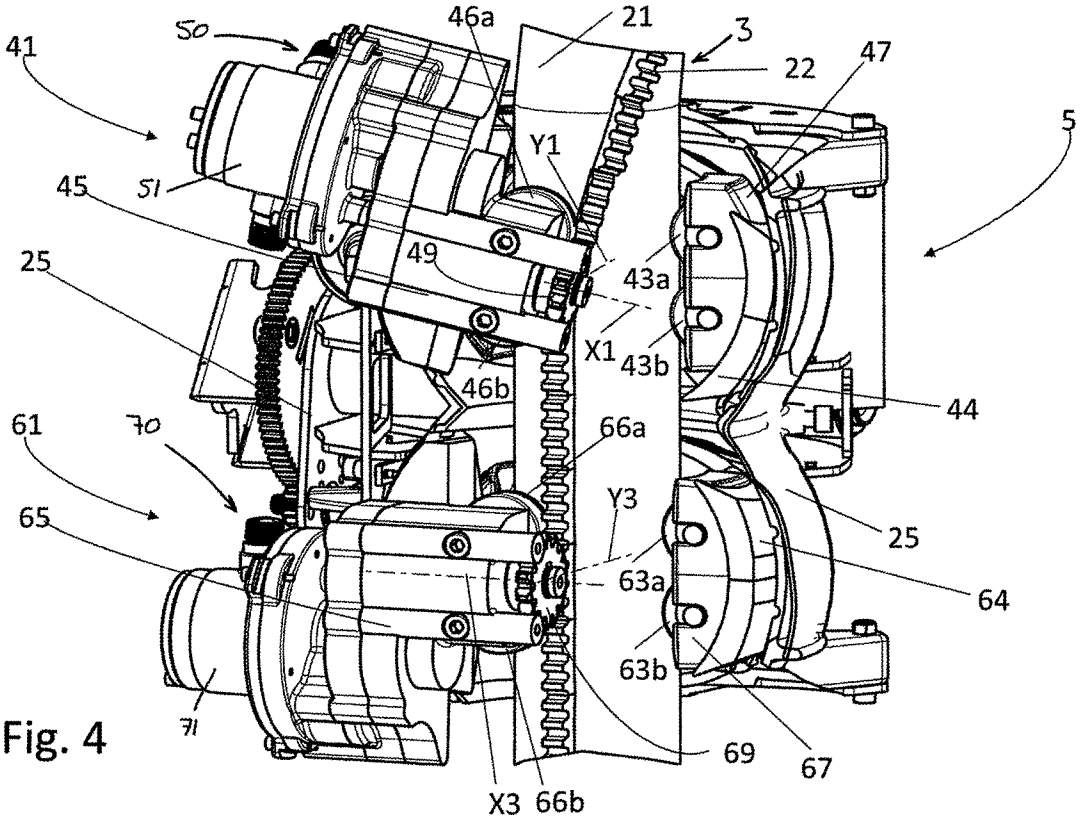
FIG. 4 shows a second perspective view of the inside of the carriage of the stairlift of FIG. 1, with a part of the rail.
Figure 5:
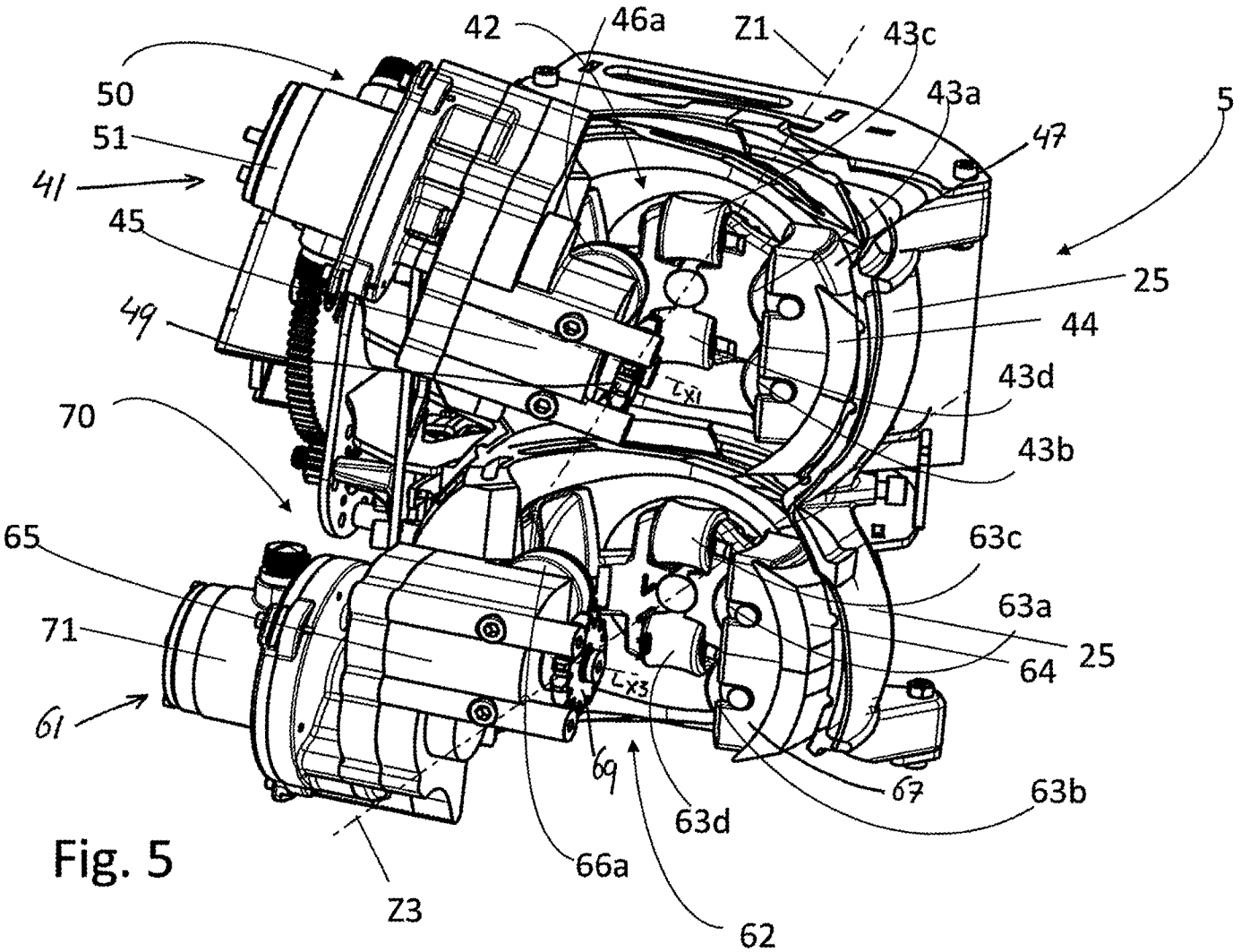
FIG. 5 shows a third perspective view of the inside of the carriage of the stairlift of FIG. 1, without a part of the rail.

The carriage drive comprises a first drive unit 41 and a second drive unit 61, which are shown in more detail in FIGS. 4 and 5. At least part of each of the drive units 41, 61 has a spherical form and is connected to the carriage frame 25 so as to form a ball-and-socket joint.

Each of the spherical drive units 41, 61 has a passage 42, 62 best seen in FIG. 5, through which the rail 3 extends when the carriage 5 has been installed. Multiple guiding wheels, being a first-, second-, third- and fourth guiding wheel 43*a*, 43*b*, 43*c*, 43*d*, 63*a*, 63*b*, 63*c*, 63*d*, are arranged around the passage 42, 62. The guiding wheels 43*a*, 43*b*, 43*c*, 43*d*, 63*a*, 63*b*, 63*c*, 63*d*, in the mounted state, bear against the tube 21 of the rail 3. The rail 3 carries the carriage 5.

In the embodiment illustrated, the drive units 41, 61 comprise a body frame 45, 65, being metal bodies. At least part of the outer surface of the body frame 45, 65 has a spherical form 44, 64. The spherical part 44, 64 is accommodated in the carriage frame 25 of the carriage 5 in a manner similar to that of a ball-and-socket joint. The drive units 41, 61 are therefore able to rotate about their imaginary centre defined by the spherical parts 44, 64. The drive units 41, 61 can, independently of one another, assume a position corresponding to the course of the rail 3.

The body frame 45, 65 of each drive unit 41,61 also accommodates a drive 50, 70, which comprises a drive gearwheel 49, 69 a transmission and an electric drive motor 51, 71. The drive gearwheel 49, 69 engages with the gear rack 22 of the rails 3. The drive gearwheel 49, 69 is rotatable around its rotation axis X1, X3. By being driven by the electric drive motor 51, 71 the drive gearwheel 49, 69 is moved along the gear rack 22, thereby moving the carriage 5 up and down along the rail 3.

The drive gearwheel 49, 69 is accommodated in the body frame 45, 65 of the drive unit 41, 61. As the body frame 45, 65 (and therefore the drive unit 41, 61) is able to rotate about its imaginary centre, the gear wheel 49, 69 is also able to pivot around an imaginary pivot axis Y1, Y2 with respect to the carriage frame 25.

The body frame 45, 65 of each drive unit 41, 61 further comprises a sub-body frame 47, 67, being for example metal bodies. In an alternative, the sub-body frame 47, 67 can be plastic bodies. Here, at least part of the outer surface of the sub-body frame 47, 67 has a spherical form. This sub-body frame 47, 67 is pivotably connected to the body frame 45, 65 along an imaginary pivot axis Z1, Z3. The guiding wheels 43*a*, 43*b*, 43*c*, 43*d*, 63*a*, 63*b*, 63*c*, 63*d* are accommodated in the sub-body frame 47, 67. Pivoting the sub-body frame 47, 67 with respect to the body frame 45, 65 therefore also results in pivoting the guiding wheels 43*a*, 43*b*, 43*c*, 43*d*, 63*a*, 63*b*, 63*c*, 63*d* with respect to the drive gearwheel 49, 69 within one drive unit 41, 61.

Thus within the first drive unit 41 the first sub-body frame 47 is pivotable with respect to the first body frame 45 allowing pivoting of the first guiding wheels 43*a*, 43*b*, 43*c*, 43*d* with respect to the first drive gearwheel 49 about its imaginary pivot axis Z1.

Within the second drive unit 61 the second sub-body frame 67 is pivotable with respect to the second body frame 65 allowing pivoting of the second guiding wheels 63*a*, 63*b*, 63*c*, 63*d* with respect to the second drive gearwheel 69 about its imaginary pivot axis Z3.

Each drive unit 41, 61 comprises two supporting wheels 46*a*, 46*b*, 66*a*, 66*b* which bear against one side of the gear rack 22. Having two supporting wheels 46*a*, 46*b*, 66*a*, 66*b* bearing against the side of the gear rack 22 allows that the carriage 5 supports on the rail 3. The supporting wheels 46*a*, 46*b*, 66*a*, 66*b* are accommodated in the body frame 45, 65 and therefore pivotable with respect to the sub-body frame 47, 67 about its imaginary pivot axis Z1, Z3.

Having a sub-body frame 47, 67 in the drive unit 41, 61 being pivotably connected to the body frame 45, 65 allows that the guiding wheels 43*a*, 43*b*, 43*c*, 43*d*, 63*a*, 63*b*, 63*c*, 63*d* are pivotable with respect to the drive gearwheels 49, 69. The guiding wheels 43*a*, 43*b*, 43*c*, 43*d*, 63*a*, 63*b*, 63*c*, 63*d* are supported by and accommodated in the sub-body frame 47, 67.

Each body frame 45, 65 is configured to rotate with respect to the carriage frame 25 such that the drive gearwheel 49, 69 is adapted to follow the gear rack 22 when the carriage 5 is moved along the rail 3.

Each sub-body frame 47, 67 is configured to pivot with respect to the body frame 45, 65 such that the guiding wheels 43*a*, 43*b*, 43*c*, 43*d*, 63*a*, 63*b*, 63*c*, 63*d* follow the tube 21 when the carriage 5 is moved along the rail 3.

In other words, a carriage 5 is provided in which the drive gearwheels 49, 69 follow the gear rack 22 of the rail 3 and in which the guiding wheels 43*a*, 43*b*, 43*c*, 43*d*, 63*a*, 63*b*, 63*c*, 63*d* follow the tube 21 of the rail 3, when the carriage 5 is moved along the rail 3.

Figure 1A:
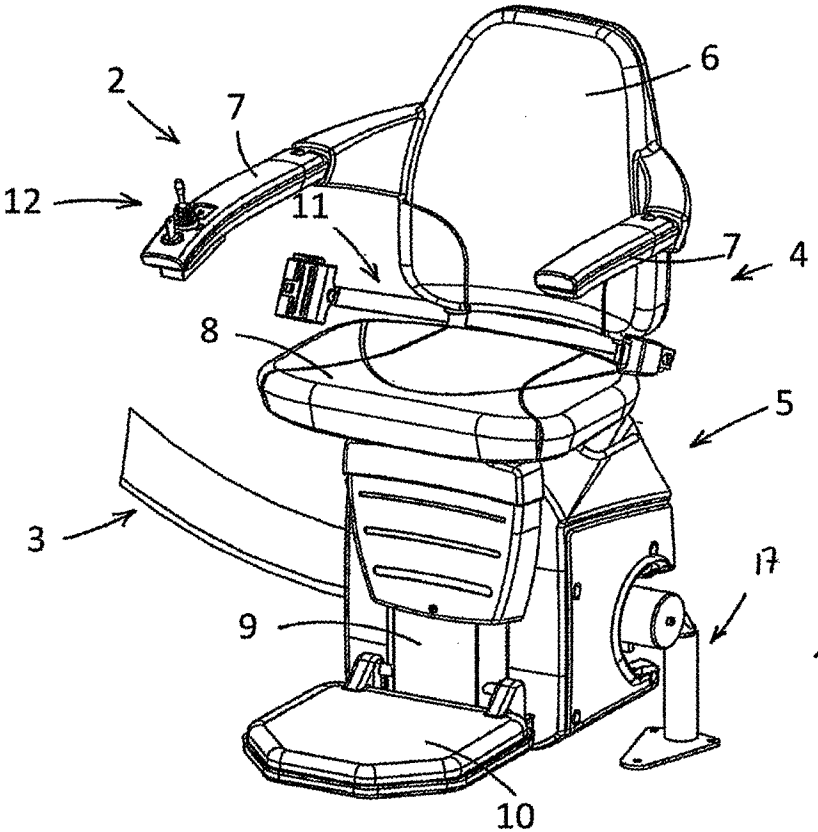
FIG. 1*a* shows an embodiment of the stairlift according to the invention.
Figure 6:
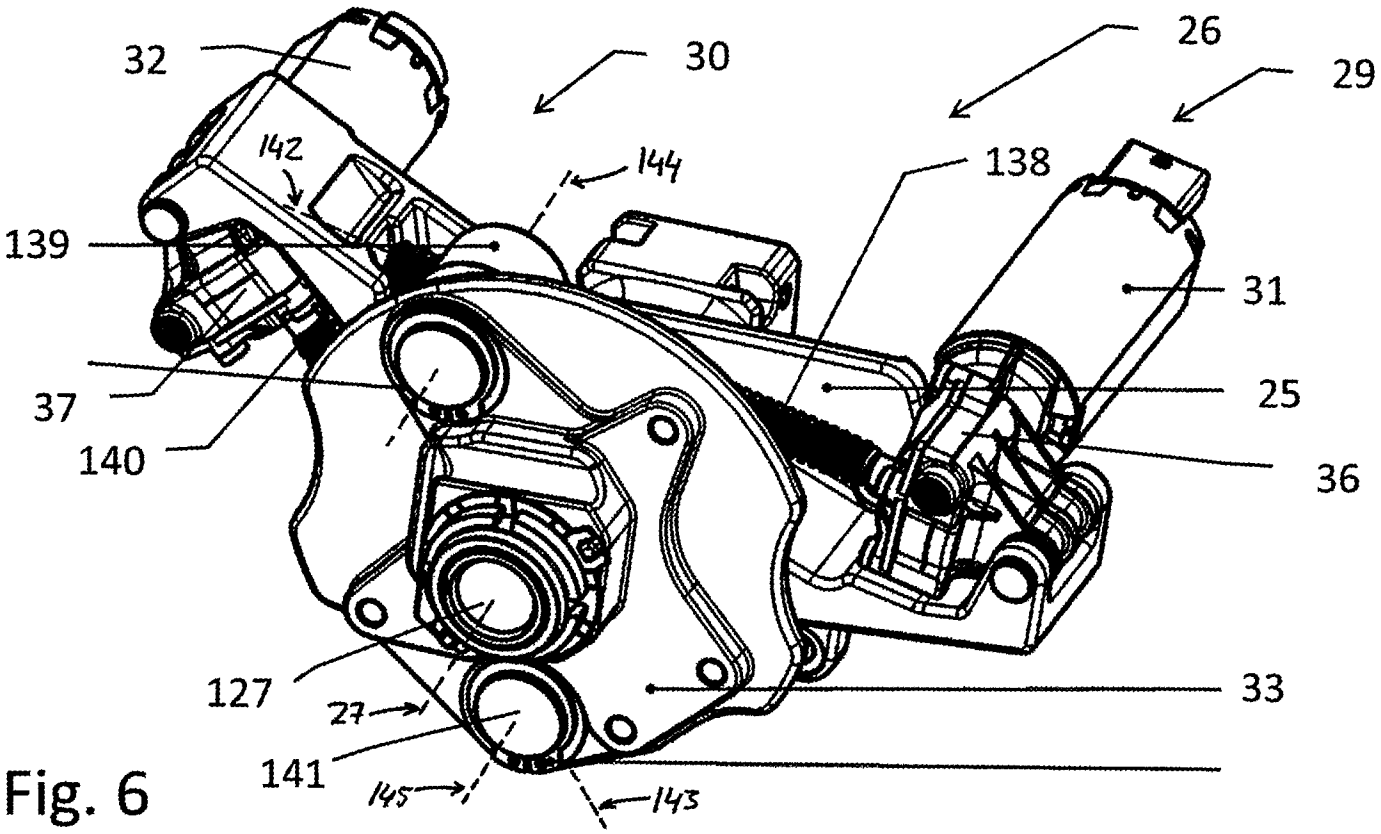
FIG. 6 shows a second embodiment of the rotation device for the stairlift of FIG. 1*a;*

FIG. 6 shows a second embodiment of the rotation device for the stairlift 2 of FIG. 1*a*. Also part of the carriage 5 is shown, such as the carriage frame 25. The second embodiment of the rotation device 26 can also be used in a different type of carriage 5.

The rotation device 26 comprises a horizontal tilt axle 27, a first rotator 29, a second rotator 30, a first motor 31, and a second motor 32. The first motor 31 and the second motor 32 are electric motors. The stairlift 2 further comprises a chair support 33.

The first rotator 29 comprises a first gear transmission 36, while the second rotator 30 comprises a second gear transmission 37. The first rotator 29 further comprises a first threaded spindle 138, and a first nut 139. The first threaded spindle 138 engages the first nut 139, and is drivingly connected to the first motor 31 via the first gear transmission 36 for rotating the first threaded spindle 138 about its first longitudinal axis 142. The first nut 139 is connected to the chair support 33 such that rotating the first threaded spindle 138 causes a linear displacement of the first nut 139 along the first threaded spindle 138. The first nut 139 is connected rotatably with the load carrier support 133 for rotating only about a first axis 144 which is perpendicular to the first longitudinal axis 142 of the first threaded spindle 138.

The second rotator 30 comprises a second threaded spindle 140, and a second nut 141, wherein the second threaded spindle 140 engages the second nut 141, and is drivingly connected to the second motor 32 for rotating the second threaded spindle 140 about its second longitudinal axis 143, and in which the second nut 141 is connected to the load carrier support 33 such that rotating the second threaded spindle 140 causes a linear displacement of the second nut 141 along the second threaded spindle 140. The second nut 141 is connected rotatably with the load carrier support 33 for rotating only about a second axis 145 which is perpendicular to the second longitudinal axis 143 of the second threaded spindle 140.

Figure 7:
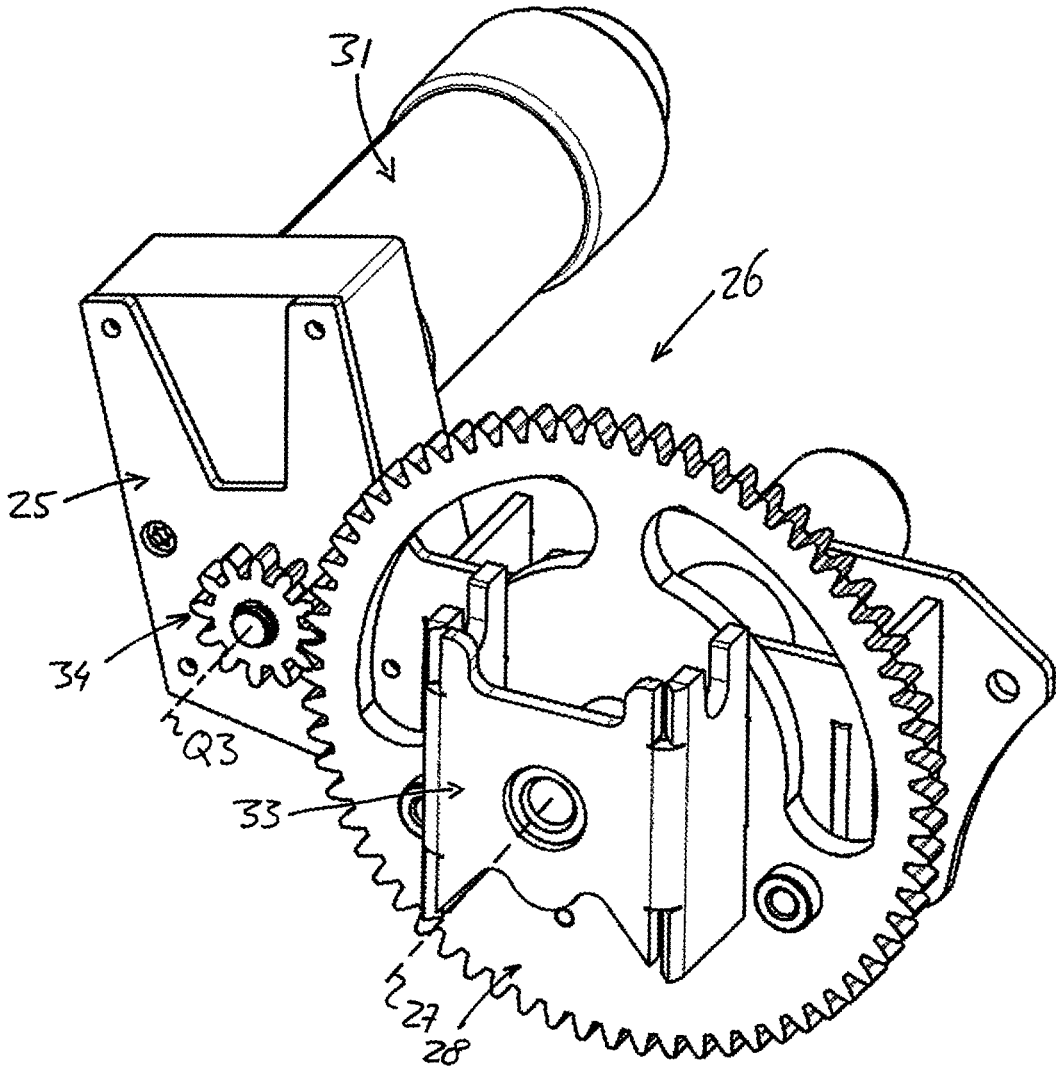
FIG. 7 shows a third embodiment of the rotation device for the stairlift of FIG. 1*a*.

FIG. 7 shows a third embodiment of the rotation device 26 for the stairlift of FIG. 1*a*. The load carrier support 33 is fixedly connected to a central gear wheel 28 in the same way as shown in FIG. 3. The central gear wheel 28 (and there load carrier support 33) can be rotated about the horizontal axis 27 via a pinion 34. Also part of the carriage 5 is shown, such as the carriage frame 25. The second embodiment of the rotation device 26 can also be used in a different type of carriage 5.

Figure 8:
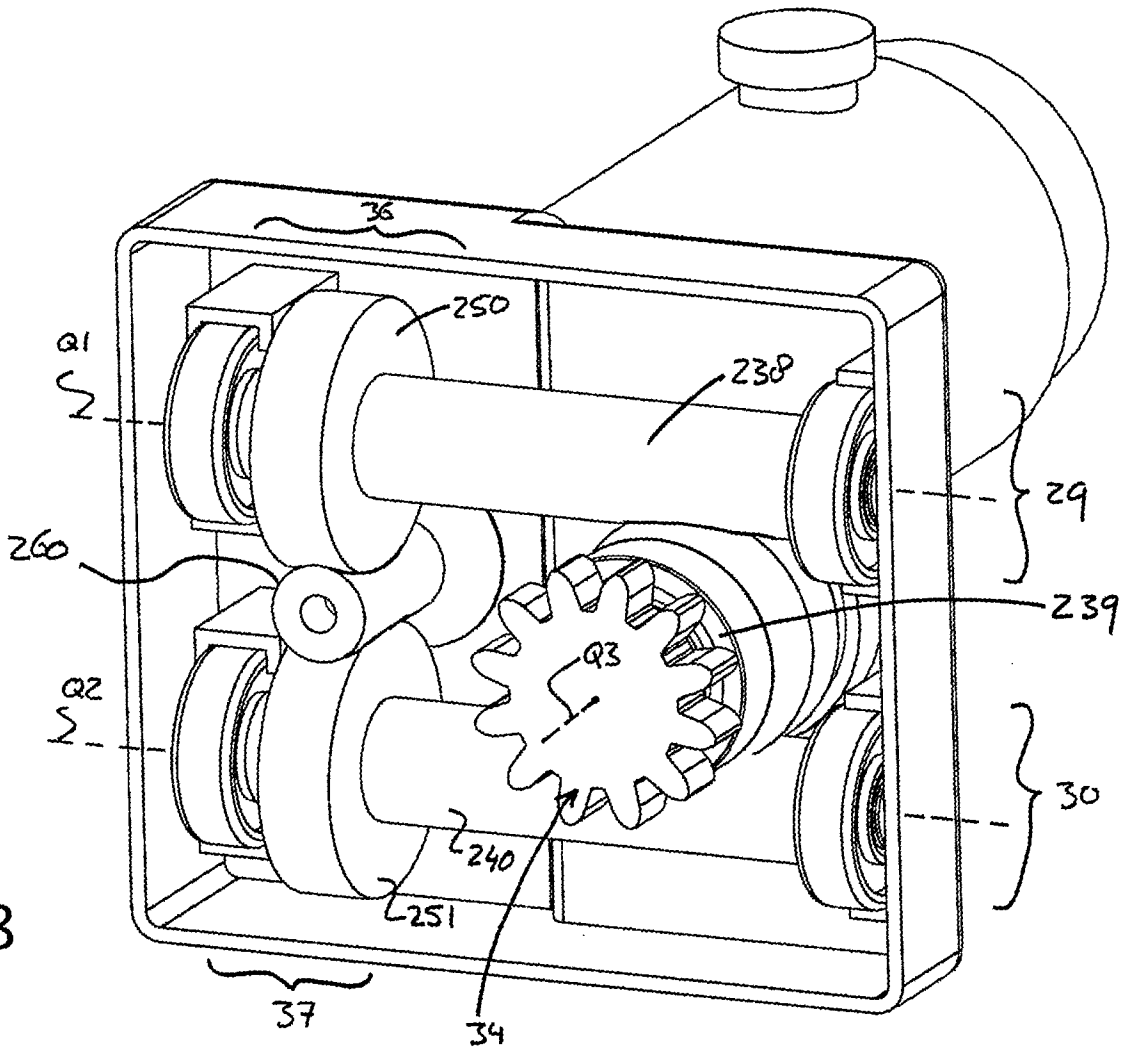
FIG. 8 shows an view on the inside of the rotation device of FIG. 7.

FIG. 8 shows a view on the inside of the rotation device of FIG. 7. The rotation device 26 comprises a first rotator 29, a second rotator 30, and a motor 31. The motor 31 is an electric motor. The motor 31 powers the first rotator 29 and the second rotator 30.

The first rotator 29 comprises a first gear transmission 36, while the second rotator 30 comprises a second gear transmission 37.

The first rotator 29 further comprises a first worm gear 238, and a first worm wheel 239. The first worm gear 238 engages the first worm wheel 239, and is drivingly connected to the first motor 31 via the first gear transmission 36 for rotating the first worm gear 238 about its longitudinal axis Q1.

The first worm wheel 239 is connected to the first worm gear 238 such that rotation of the first worm gear 238 about the rotation axis Q1 causes a rotation of the first worm wheel 239 about its rotation axis Q3. The first worm wheel 239 is connected to the pinion 34, such that rotation of the first worm wheel 239 about the rotation axis Q3, causes a rotation of the pinion 34 about the rotation axis Q3. Due the central gear wheel 28, the load carrier support 33 is rotated about the horizontal axis 27 when the pinion 34 is rotated. The rotation axis Q3 extends perpendicular to the longitudinal axis Q1 of the first worm gear 238.

The second rotator 30 comprises a second worm gear 240. The second worm gear 240 engages the first worm wheel 239, and is drivingly connected to the motor 31 for rotating the second worm gear 240 about its longitudinal axis Q2. The second worm wheel 239 is connected to the second worm gear 240 such that rotation of the second worm gear 240 about the rotation axis Q2 causes a rotation of the first worm wheel 239 about its rotation axis Q3. The rotation axis Q3 extends perpendicular to the longitudinal axis Q2 of the second worm gear 240.

The first gear transmission 36 comprises a first transmission worm wheel 250 connected to the first worm gear 238. The first transmission worm wheel 250 engages with a motor worm 260. Rotation of the motor worm 260, which is drivingly connected to the motor 31, results in the first transmission worm wheel 250 being rotated about the rotational axis Q1. This results in a rotation of the first worm gear 238 about the rotational axis Q1.

The second gear transmission 37 comprises a second transmission worm wheel 251 connected to the second worm gear 240. The second transmission worm wheel 251 engages with the motor worm 260. Rotation of the motor worm 260, which is drivingly connected to the motor 31, results in the second transmission worm wheel 251 being rotated about the rotational axis Q2. This results in a rotation of the second worm 240 about the rotational axis Q2.

This has as advantage that a redundant and safe driving rotation of the chair support 33 with respect to the carriage 5 is possible, in order to position the chair in the desired orientation. When one of the rotators 29, 30 fails, e.g. when one of the worms gears 239, 240 breaks, the other worm gear 239, 240 is able to keep the chair support 33 at in the desired position.

A gear transmission is not always necessary, if the motor can be located in the right orientation and provides the required speed range and/or torque. Another rotator could be a worm acting on the central gearwheel of the first embodiment. Other types of motor may be used, such as a hydraulic motor, which may or may not be a rotation motor. Motor and rotation device could be together embodied by a powered cylinder, such as a hydraulic cylinder. Instead of an axle, a horizontal rotation axis can also be proved by other types of rotational bearings.

It is also possible to provide a wheelchair platform rather than a chair, which wheelchair platform is maintained in a horizontal position in the manner described in the invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms “a” or “an”, as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

It will be apparent to those skilled in the art that various modifications can be made to the device and method without departing from the scope as defined in the claims.

The invention claimed is:

1. A stairlift for conveying a load along a staircase, comprising;

a rail;

a carriage carried by the rail and moveable along the rail;

a carriage drive to drive the carriage along the rail;

a load carrier support supporting a load carrier, such as a chair or wheelchair platform, which load carrier support is rotatably connected to the carriage to rotate about a horizontal axis;

a rotation device to rotate the load carrier support relative to the carriage about the horizontal axis; and a control unit to control the rotation device such that the load carrier support is positioned in a desired orientation relative to a horizontal plane;

wherein the rotation device comprises at least one motor and a first rotator, wherein at least one of the at least one motor is operatively connected to the load carrier support via the first rotator to cause rotation of the load carrier support relative to the carriage about the horizontal axis, and wherein the rotation device comprises a second rotator which operatively connects at least one of the at least one motor to the load carrier support via the second rotator to cause rotation of the load carrier support relative to the carriage about the horizontal axis in unison with the first rotator.

2. The stairlift according to claim 1, wherein the at least one motor of the rotation device comprises a first motor and a second motor, the first motor is operatively connected to the load carrier support via the first rotator, and the second motor is operatively connected to the load carrier support via the second rotator.

3. The stairlift according to claim 2, wherein the control unit is configured to operate the second motor in unison with the first motor.

4. The stairlift according to claim 2, wherein the first motor and the second motor have substantially the same level of power output.

5. The stairlift according to claim 2, wherein the first rotator comprises a first pinion and a first toothed surface, wherein the first toothed surface is drivingly connected to the load carrier support, and the first pinion is drivingly connected to the first motor and engages the first toothed surface.

6. The stairlift according to claim 5, wherein the second rotator comprises a second pinion and a second toothed surface, wherein the second toothed surface is drivingly connected to the load carrier support, and the second pinion is drivingly connected to the second motor and engages the second toothed surface.

7. The stairlift according to claim 6, wherein the rotation device comprises a central gearwheel which is drivingly, preferably rotationally fixed, connected to the load carrier support, and teeth of the central gearwheel form the first toothed surface and the second toothed surface.

8. The stairlift according to claim 2, wherein the first rotator and the second rotator comprises a transmission configured to change the direction and/or speed of rotation of the first motor and the second motor, respectively.

9. The stairlift according to claim 2, wherein the first rotator and the second rotator comprises gears configured to change the direction and/or speed of rotation of the first motor and the second motor, respectively.

10. The stairlift according to claim 2, wherein the first motor and the second motor are electric motors.

11. The stairlift according to claim 2, wherein each of the first motor and the second motor is configured to block the rotation of the load carrier support about the horizontal axis when the second motor or the first motor, respectively, stops functioning.

12. The stairlift according to claim 2, wherein each of the first motor and the second motor is configured to rotate the load carrier support about the horizontal axis when the second motor or the first motor, respectively, stops functioning.

13. The stairlift according to claim 1, wherein the first rotator comprises a first threaded spindle, and a first nut, wherein the first threaded spindle engages the first nut, and is drivingly connected to the first motor for rotating the first threaded spindle about its first longitudinal axis, and in which the first nut is connected to the load carrier support such that rotating the first threaded spindle causes a linear displacement of the first nut along the first threaded spindle.

14. The stairlift according to claim 13, wherein the first nut is connected rotatably with the load carrier support for rotating only about a first axis which is perpendicular to the first longitudinal axis of the first threaded spindle.

15. The stairlift according to claim 13, wherein the at least one motor of the rotation device comprises a first motor and a second motor, the first motor is operatively connected to the load carrier support via the first rotator, and the second motor is operatively connected to the load carrier support via the second rotator; and wherein the second rotator comprises a second threaded spindle, and a second nut, wherein the second threaded spindle engages the second nut, and is drivingly connected to the second motor for rotating the second threaded spindle about its second longitudinal axis, and in which the second nut is connected to the load carrier support such, that rotating the second threaded spindle causes a linear displacement of the second nut along the second threaded spindle.

16. The stairlift according to claim 15, wherein the second nut is connected rotatably with the load carrier support for rotating only about a second axis which is perpendicular to the second longitudinal axis of the second threaded spindle.

17. The stairlift according to claim 1, wherein the carriage drive comprises at least two drive units, which drive units are each rotatably connected to the carriage and each comprise at least one drive gearwheel engaging a gear rack of the rail.

18. The stairlift according to claim 1, wherein the second rotator is configured to operate in unison with the first rotator, and the at least one motor of the rotation device comprises only one motor which is connected to the load carrier support via the first rotator and the second rotator.

* * * * *